US008430084B2

(12) United States Patent
Puettmann et al.

(10) Patent No.: US 8,430,084 B2
(45) Date of Patent: Apr. 30, 2013

(54) METHOD FOR OPERATING A MULTI-SPARK IGNITION SYSTEM, AND MULTI-SPARK IGNITION SYSTEM

(75) Inventors: Lothar Puettmann, Weissach (DE); Jochen Reiter, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 370 days.

(21) Appl. No.: 12/802,099

(22) Filed: May 28, 2010

(65) Prior Publication Data

US 2010/0307468 A1 Dec. 9, 2010

(30) Foreign Application Priority Data

Jun. 9, 2009 (DE) ..... 10 2009 026 852

(51) Int. Cl.
*F02P 15/08* (2006.01)
*F02P 15/12* (2006.01)

(52) U.S. Cl.
USPC ..... 123/636; 123/637

(58) Field of Classification Search ..... 123/636, 123/637, 638, 644, 649, 652, 655, 604; 701/102
See application file for complete search history.

(56) References Cited

U.S. PATENT DOCUMENTS

| | | | | |
|---|---|---|---|---|
| 6,557,537 | B2 * | 5/2003 | Ikeda et al. | 123/606 |
| 6,675,784 | B2 * | 1/2004 | Nagase et al. | 123/603 |
| 7,392,798 | B2 * | 7/2008 | Wada et al. | 123/620 |
| 2007/0175461 | A1 * | 8/2007 | Wada et al. | 123/637 |

* cited by examiner

*Primary Examiner* — Mahmoud Gimie
(74) *Attorney, Agent, or Firm* — Kenyon & Kenyon LLP

(57) ABSTRACT

A method for operating a multi-spark ignition system in an engine system includes: receiving time information regarding a multi-spark phase; cyclical charging of an ignition coil of an ignition device, and discharging of the ignition coil via a spark plug of the ignition device during the multi-spark phase; the charging and/or discharging of the ignition coil taking place as a function of a current flow in the ignition coil.

8 Claims, 4 Drawing Sheets

METHOD FOR OPERATING A MULTI-SPARK IGNITION SYSTEM, AND MULTI-SPARK IGNITION SYSTEM

BACKGROUND OF THE INVENTION

1. Field of the Invention

The present invention relates to a multi-spark ignition system for an internal combustion engine, in which an air-fuel mixture introduced into a combustion chamber is ignited via a spark plug. The ignition system may be operated both in single-spark operation and in multi-spark operation.

2. Description of Related Art

Ignition devices are already known in which an ignition coil is charged on the primary side and energy is introduced into a combustion chamber of a cylinder on the secondary side by short-circuiting the ignition coil. The duration of this ignition process is restricted to approx. one millisecond, and the flame development of the mixture depends on an ignitable mixture being present in the region of the electrodes at this point in time. However, in modern jet-directed internal combustion engines featuring gasoline direct injection the instant when the mixture at the electrodes is ignitable cannot always be restricted to the narrow time period of an ignition spark in a conventional single-spark ignition, due to the charge movement and reasons related to the combustion chamber.

To extend the ignition period, a multi-spark operation is provided, at least under certain operating conditions; during an ignition phase, the primary side of the ignition coil is charged and discharged multiple times, so that a quasi continuous electric arc is produced at the spark plug, which exists over a longer period of time than in a single-spark operation.

BRIEF SUMMARY OF THE INVENTION

It is an object of the present invention to provide a method for operating a multi-spark ignition system, a multi-spark ignition system, as well as an engine control and an ignition device, which are suitable for operating the ignition system both in single-spark operation and in multi-spark operation, and which provide a safeguard against malfunctions in addition.

According to a first aspect, a method for operating a multi-spark ignition system is provided in an engine system. The method comprises the following steps:

Receiving time information regarding a multi-spark phase;

Cyclical charging of an ignition coil of an ignition device, and discharging of the ignition coil via a spark plug of the ignition device during the multi-spark phase;

the charging and/or discharging of the ignition coil taking place as a function of a current flow in the ignition coil.

The above method allows the automatic execution of a multi-spark operation in an ignition device, so that no external triggering of the ignition device is necessary for the multi-spark operation. Since the charging and discharging of the ignition coil is controlled by a current flow in the ignition device, the multi-spark operation may be implemented automatically, in accordance with externally received time information.

Furthermore, the charging and discharging of the ignition coil may be performed as a function of a current flow through a primary circuit of the ignition coil, and as a function of a current flow through a secondary circuit of the ignition coil.

According to one example embodiment, the charging of the ignition coil may be implemented as a function of the attainment or exceedance of a switch-off threshold by the current flow in the primary circuit of the ignition coil, and as a function of the discharging of the ignition coil by attaining or not attaining a switch-on threshold by the current flow in the secondary circuit of the ignition coil.

Furthermore, prior to the time information regarding the multi-spark phase, time information regarding a single-spark phase may be received, the start of the single-spark phase indicating the start of the charging of the ignition coil, and the end of the single-spark phase indicating the start of the discharging of the ignition coil.

The time information regarding the multi-spark phase and the time information regarding a single-spark phase may be supplied by front and rear edges of a second or first pulse of a control signal provided to the ignition device.

In this way an ignition device is able to be triggered in such a way that, for one, the instant of a single spark in single-spark operation, or the instant of the first spark in multi-spark operation, as well as the time period during which an electric arc is generated in the combustion chamber by multiple sparks are able to be defined in an unambiguous manner. This is accomplished by a suitable communication protocol between the engine control device and the ignition device. The communication protocol provides for a first pulse, during which the primary coil is charged and at whose rear edge the first ignition spark is produced. Then, a further pulse is communicated to the ignition device, which, via its front and rear edges, indicates the start and the end of the multi-spark phase, during which the primary coil is repeatedly charged and discharged via the spark plug in order to generate a multi-spark electric arc in the combustion chamber. This makes it possible to suitably specify the instant of the single spark or the first spark in a precise manner, and the time period during which multiple ignitions take place in a multi-spark operation is likewise able to be specified via the instant of the rear edge of the second pulse.

Furthermore, a minimum time period may be provided between the first and the second pulse.

At least one of the front and rear edges of the first and second pulse in the ignition device may be debounced.

Moreover, the time information regarding the multi-spark phase may correspond to a maximum number of ignition processes, the number of ignition processes in the multi-spark phase being restricted to the maximum number.

According to a further aspect, an ignition device for operating an internal combustion engine is provided. The ignition device includes:

- a spark plug for generating a single spark or a multiple spark;
- an ignition coil for operating an ignition voltage for the spark plug;
- a control logic which is designed to receive time information regarding a multiple spark phase in order to cyclically charge the ignition coil during the multi-spark phase and to discharge the ignition coil via the spark plug, the control logic furthermore being designed to implement the charging and/or the discharging of the ignition coil as a function of a current flow in the ignition coil.

Furthermore, the control logic may be designed to implement the charging and discharging of the ignition coil as a function of a current flow through a primary circuit of the ignition coil, and as a function of a current flow through a secondary circuit of the ignition coil.

The control logic may be designed to receive time information regarding a single-spark phase prior to the time information regarding the multi-spark phase, the start of the single-spark phase indicating the start of the charging of the ignition coil, and the end of the single-spark phase indicating the start of the discharging of the ignition coil.

More specifically, the control logic may be designed to receive the time information regarding the single-spark phase in the form of a first pulse of a control signal during an ignition phase, and to receive the time information regarding the multi-spark phase in the form of a second pulse of a control signal, the time information being provided by front and rear edges of the particular pulse.

According to a further aspect, an engine control device for operating an internal combustion engine having the above ignition device is provided, the engine control device being designed to generate a first pulse of a control signal for triggering an individual spark in the ignition device, and to generate a second pulse of the control signal as a function of a type of ignition operation, the duration of the second pulse defining the duration of a multi-spark phase in the ignition device.

According to a further aspect, an ignition system having the above engine control device and the above ignition device is provided.

DETAILED DESCRIPTION OF THE INVENTION

Figure 1:
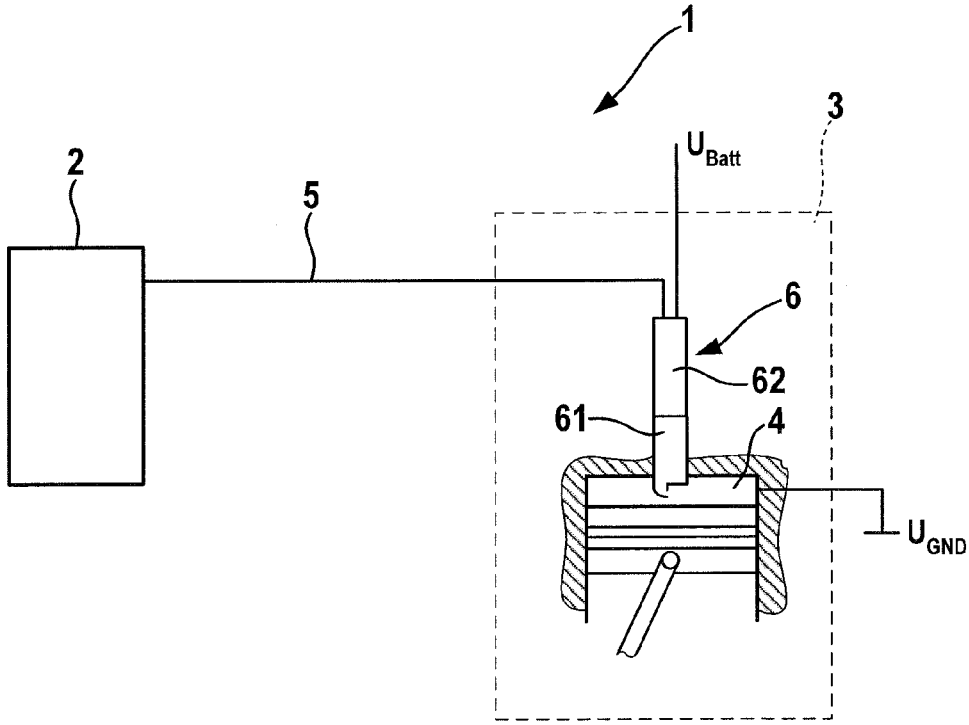
FIG. 1 shows a schematic illustration of an engine system having an ignition system for a cylinder of an internal combustion engine.

FIG. 1 shows an engine system 1 having a control device 2 and an internal combustion engine 3. Internal combustion engine 3 includes a plurality of cylinders 4, of which one is shown explicitly in FIG. 1. In addition to controlling the air charge, e.g., via the setting of the throttle valve, the injection quantity, e.g., via control of the injection nozzle for the direct injection of fuel into the cylinder, engine control device 2 is designed to provide a trigger signal for ignition devices 6 assigned to each cylinder 4. These trigger signals are transmitted via corresponding communications lines 5, only one of which is being shown.

Via communications line 5, engine control device 2 transmits a trigger signal for operating ignition device 6 according to a predefined operating mode. Ignition device 6 includes a spark plug 61 and an ignition coil unit 62, which are interconnected. Spark plug unit 61 is triggered with the aid of ignition coil unit 62 in order to generate one or a plurality of ignition spark(s) in the combustion chamber of cylinder 4 on which ignition device 6 is situated. For this purpose, spark plug unit 61 has two electrodes that reach into the interior of cylinder 4. Ignition device 6 is also connected to battery voltage $U_{Batt}$, and, via the engine body, to battery mass $U_{GND}$.

Figure 2:
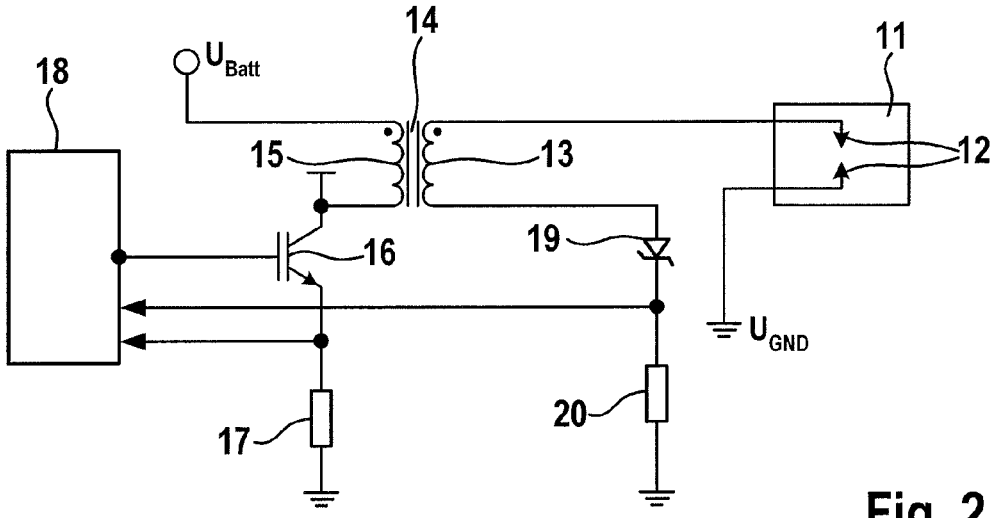
FIG. 2 shows an ignition device of the engine system of FIG. 1.

An ignition device 6 as it is used in the engine system of FIG. 1 is shown in detail in FIG. 2. Ignition device 6 includes spark plug 11, which is disposed inside spark plug unit 61 and whose two electrodes 12 reach into the combustion chamber of cylinder 4. One of electrodes 12 is connected to ground potential $U_{GND}$, and a further electrode 12 is connected to a first terminal of a secondary coil 13 of ignition coil 14 designed as transformer. In addition, ignition coil 14 includes a primary coil 15, a first terminal of primary coil 15 being connected to battery voltage $U_{Batt}$, and a second terminal of primary coil 15 being connected to ground potential $U_{GND}$ of the battery mass via an electronic power switch such as an IGBT 16, and via a first measuring resistor 17.

Electronic power switch 16 is connected via its gate terminal to a control logic 18 provided in ignition device 6, so that the electronic power switch is able to be switched in a manner controlled by control logic 18. A second terminal of primary coil 15 is connected to battery mass $U_{GND}$ via an energizing-spark suppression diode 19 and a second measuring resistor 20. Energizing-spark suppression diode 19 ensures that no current is able to flow through secondary coil 13 while primary coil 15 is in the process of being charged.

Ignition coil unit 62 and spark plug unit 61 may be formed jointly or be connected to one another by a supply lead which normally is between 10 and 15 centimeters in length. In addition, control logic 18 is connected to the terminal of first and second measuring resistors 17, 20 that are not connected to ground potential $U_{GND}$, so that information about the measuring voltage applied there is able to be recorded. The information about the measuring voltages constitutes information concerning the currents in the primary circuit (current through primary coil 15) and in secondary circuit (current through secondary coil 13).

The method of functioning of the ignition device of FIG. 2 is as follows: By closing power switch 16, the battery voltage is applied at primary coil 15, so that a current is able to flow through the primary coil of the ignition coil, which charges primary coil 15 with energy, i.e., generates a magnetic field in the ignition coil. Once this charge period has ended, which is also referred to as closing time, power switch 16 is switched off, and the magnetic energy stored in transformer 14 is converted into a high electric ignition voltage in secondary coil 13. If the ignition voltage generated in this manner exceeds the ignition voltage requirement of spark plug 11, then the secondary current begins to flow.

Firing of the spark plug is triggered by the ignition voltage generated on the secondary side. The spark plug fires when the secondary voltage exceeds the ignition voltage requirement of the spark plug. In an arc-over, the current in the secondary circuit rises very steeply in a pulse-like manner, reaching peak currents in excess of 100 A for the duration of a few nano-seconds. Subsequently, the voltage over the spark plug rapidly drops to a low intermediate level of only 100 Volt, the current dropping to a medium level of approx. 10 A as a result of the so-called streamer. This temporarily stable state is referred to as arc-discharge phase and lasts for a total of approximately one microsecond. This is followed by the burn- or glow phase, which is characterized by an approximately tenfold higher spark voltage (approx. 1 kilovolt) and by a current that is slowly decreasing to a level featuring an initial current of approx. 100 mA.

In general, a spark in single-spark operation of the spark plug exists for approx. 1 μs. By creating corresponding injection conditions, it must therefore be ensured that an ignitable mixture is present at the instant when the single spark is initiated at electrodes 12 of spark plug 11. In internal combustion engines having critical ignition conditions due to charge stratification or lean mixtures, it may therefore happen that an ignition fails to occur if the instant of the ignition spark is not precisely adapted to the ignitability of the air-fuel mixture in the combustion chamber. This problem is solved by extending the period during which an ignition may take place (continuous spark ignition, CSI).

Figure 3:
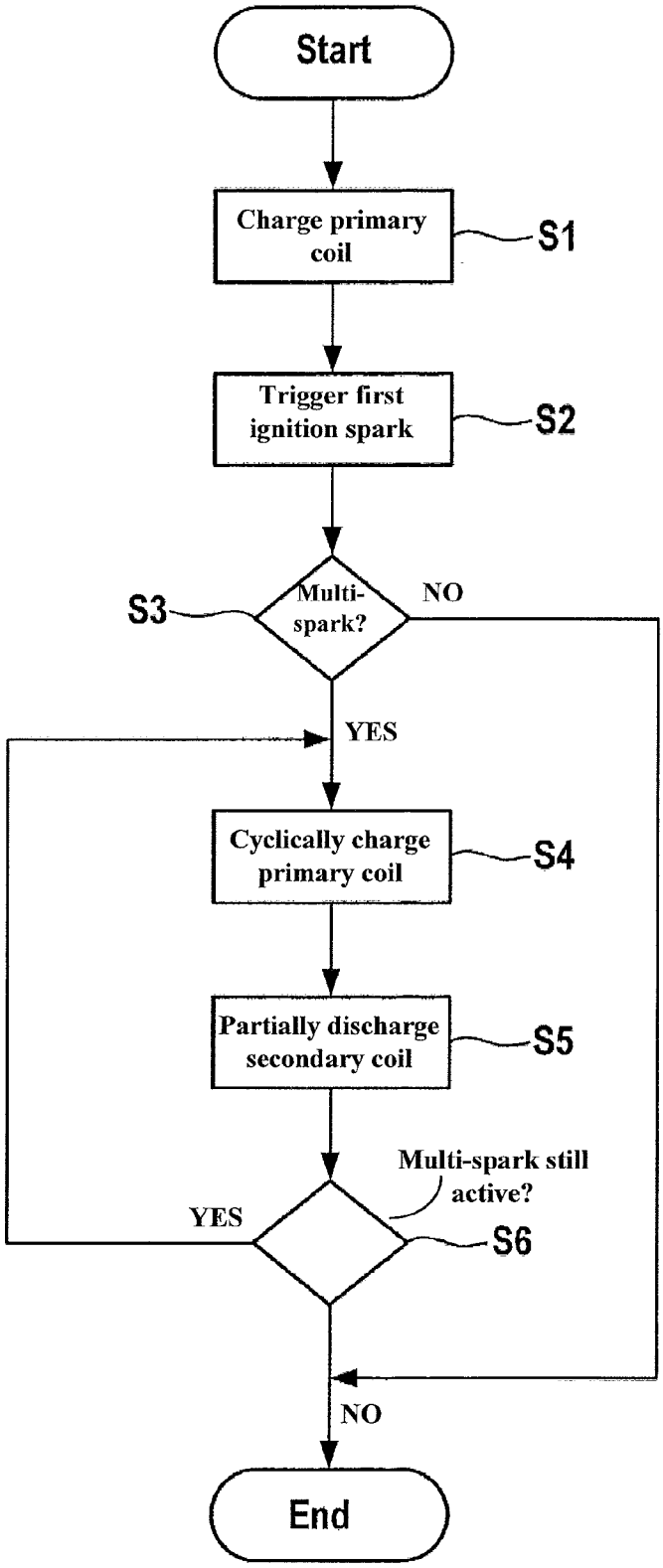
FIG. 3 shows a flow chart of a method for operating the ignition device.

FIG. 3 shows a flow chart to illustrate the method for operating ignition device 6. In every ignition phase which indicates the time period during which firings may take place in cylinder 4 by ignition device 6, the method is started anew. In the process, in a step S1, primary coil 15 is first charged for a time calculated by engine control device 2, as is customary in conventional ignition systems. The charge time corresponds to the closing time. At the calculated ignition instant, a first ignition spark is triggered (step S2) by switching off power switch 16, controlled by engine control device 2.

In a step S3, it is determined in engine control device 2 whether a multi-spark operation is intended. If this is the case (alternative: yes), a multi-spark regulation is activated in ignition device 6, which during a multi-spark operation cyclically charges the primary coil (step S4) for a predefined period of time and subsequently partially discharges secondary coil (step S5). Otherwise, the method is terminated until the next ignition phase.

In step S6, it is checked whether the multi-spark operation is still active. If it is determined in step S6 (alternative: no) that the time period specified by engine control device 2 for the multi-spark phase has elapsed (alternative: yes), then the method will be terminated. If the time period of the multi-spark phase has not yet elapsed (alternative: no), a return to step S4 takes place and a new cycle featuring charging of the ignition coil (current flow through primary coil 15) and discharging of the ignition coil via the spark plug is implemented in step S5.

The charge and discharge cycle in multi-spark operation is performed according to a two-point control by control logic 18 of the ignition device. The charge and discharge cycle is undertaken by control logic 18 for as long as this is indicated by a corresponding control signal from engine control device 2. Toward this end, a switch-off threshold is defined for the primary current, and a switch-on threshold for the secondary current. If the primary current lies below the switch-off threshold and the secondary current below the switch-on threshold, then power switch 16 is switched on.

The switched-on state of power switch 16 is assumed for a minimum period of time that lies between 20 and 50 μs, for example, preferably between 30 and 40 μs, preferably approx. 35 μs. Following the minimum switch-on time, the primary current is compared to the switch-off threshold, and the power switch is switched off if the primary current attains or exceeds the switch-off threshold. The switch-off of power switch 16 triggers an ignition spark.

Power switch 16 is kept in the switched-off state for a minimum switch-off period lasting between 10 and 30 μs, preferably between 15 and 25 μs, e.g., 20 μs. The secondary current is then compared to the switch-on threshold, and if the secondary current reaches the switch-on threshold, power switch 16 is switched on in order to charge primary coil 15. This algorithm runs cyclically in an automatic manner as a function of the actually effective physical circumstances of the ignition coil and the spark plug, for as long as indicated by engine control device 2 as duration of the multi-spark phase.

It may be provided that the cycle is not directly interrupted by engine control device 2 at the end of the multi-spark phase, but that the charging continues up to the switch-off threshold and no renewed charging of primary coil 15 takes place subsequently. That is to say, the cyclical charging and discharging is interrupted merely by preventing the process of the further switching-on of power switch 16.

To implement the multi-spark operation, information about the currents flowing in the primary circuit and the secondary circuit must be made available to control logic 18. The primary current and the secondary current may basically be detected in different ways. In the exemplary embodiment shown in FIG. 2, first and second measuring resistors 17, 20 are disposed in the primary circuit and secondary circuit, respectively, above which a corresponding measuring voltage drops when a current flows, which drop is detected by control logic 18.

In addition to or as an alternative to the specified time duration for the multi-spark phase for terminating the multi-spark phase, control logic 18 may restrict the number of ignition processes in the multi-spark phase to a specified number. This may be accomplished with the aid of a counter implemented in control logic 18, for instance, and a comparator (not shown).

Control logic 18 may be realized as an ASIC (application-specific integrated circuit) and includes an analog-digital converter for digitizing the measuring voltages thus detected, so that information about the currents flowing in the primary circuit and secondary circuit is obtained. Other types of measurements of the current in the primary circuit and secondary circuit are conceivable as well and may be implemented in the described ignition system. All that is required is that control logic 18 is supplied with suitable information from which the primary current and the secondary current are able to be derived.

When primary coil 15 is charged, the current flow through the coil rises continuously due to its inductivity, until the switch-off threshold has been reached. The switch-off threshold corresponds to a current value that is equal to or less than the maximum current through the primary coil in the completely charged state. The switch-on threshold, to which the secondary current is compared, is selected such that residual energy remains in the secondary coil, i.e., the primary circuit is switched on despite the fact that the magnetic energy of ignition coil 14 has not yet been completely released via the secondary circuit.

In the CSI system, it may happen that the initial spark current already lies below the switch-on threshold, so that power switch 16 would immediately be switched on again in order to charge ignition coil 14, and no significant transmission of ignition energy into the spark would occur as a result. For this purpose, the implementation of a minimum switch-off time is provided, during which the ignition energy is able to be transmitted.

Figure 4:
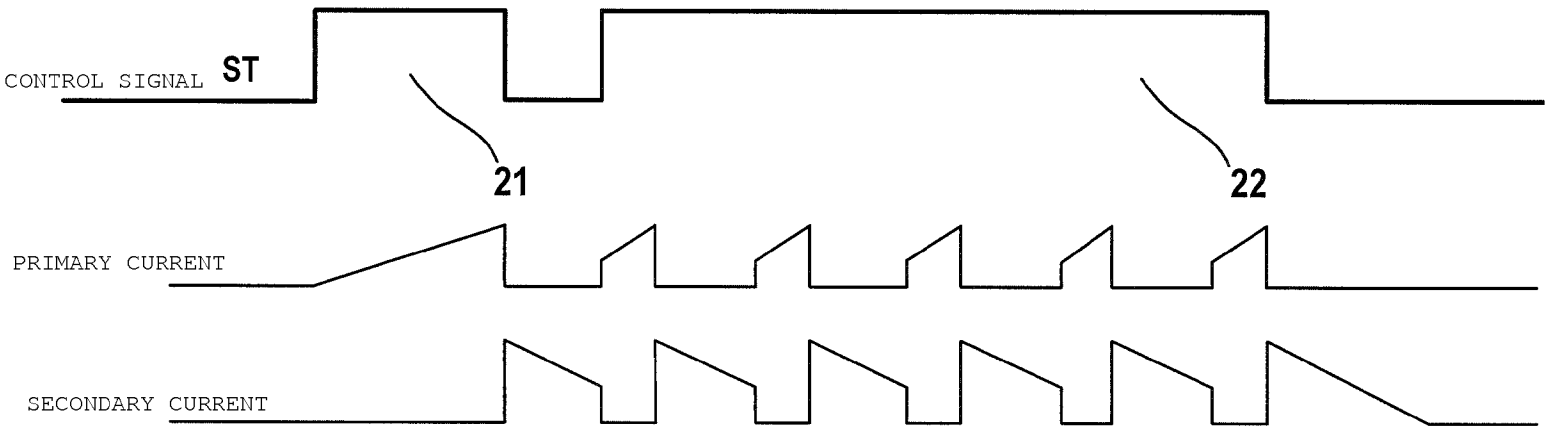
FIG. 4 shows a signal-time diagram to illustrate the characteristic of the control signal as well as the characteristic of the primary current and secondary current in the ignition device.

FIG. 4 shows a signal diagram, which represents the time characteristic of a control signal that is transmitted from engine control device 2 to ignition device 6 via communications line 5. When the cylinder is to be operated in single-spark operation, engine control device 2 transmits a single pulse to ignition device 6. In the event that the cylinder of the internal combustion engine is to be operated in multi-spark operation, two consecutive pulses within one ignition phase are transmitted to ignition device 6.

First pulse 21 of the control signal has a front edge and a rear edge. The front edge, which is a leading edge in the exemplary embodiment shown, is used for switching power switch 16 on and for starting the charge phase of primary coil 15. The rear edge of first pulse 21 of the control signal switches power switch 16 off and thereby triggers the discharge phase on the secondary side of ignition device 6. The pulse duration between the front flank and the rear flank is calculated by engine control device 2 and is defined by operating parameters such as the battery voltage and the temperature of engine 3, for example. In other words, the instant of the front edge of first pulse 21 is derived from the pulse duration and the ignition instant that corresponds to the instant of the rear edge of the first pulse. As a result, first pulse 21 is able to generate a temporally defined ignition at the instant of the rear edge of the first pulse. In single-spark operation, first pulse 21 corresponds to the single pulse during the entire ignition phase.

In multi-spark operation, first pulse 21 is followed by a second pulse 22 whose pulse duration corresponds to the period during which a continuous electric arc is to be present by cyclical charging and discharging of the ignition coil. During the second pulse, control logic 18 thus implements the afore-described charge/discharge control in ignition device 6, the temporal length of the individual charge and discharge operations not being specified by engine control device 2, but resulting solely from the switch-on threshold and switch-off threshold stored in ignition device 6.

As shown in FIG. 4, starting at the instant of the front edge of first pulse 21, the primary current rises up to a value specified by the rear edge of the first pulse. The current flow is abruptly interrupted by the rear edge of first pulse 21, which produces a secondary voltage by which spark plug 11 ignites. The plasma produced in spark plug 11 causes a current flow that decreases over the time. First pulse 21 is followed by second pulse 22, during which charge and discharge processes alternate, the primary current during the multi-spark phase resulting from residual energy of primary coil 15 and not rising to the maximum current of the first firing through suitable selection of the switch-off threshold. The switch-off of power switch 16 causes an ignition, during which the secondary current decreases until the switch-on threshold has been attained again. The ignition phase is essentially defined as the time period between the earliest possible front edge of the first pulse and the latest possible rear edge of the second pulse.

Between first pulse 21 and second pulse 22 of the control signal lies a minimum pause, which lasts for as long as it takes for the energy stored in the secondary coil to be transformed into a corresponding first ignition spark.

Furthermore, an overcurrent detection, which checks the primary current with respect to a maximum current threshold value, may be implemented in control logic 18. If the primary current exceeds the maximum current threshold value, then this will cause an immediate switch-off of power switch 16 during the ignition phase. To ensure that a following second pulse of the control signal does not trigger another spark, a blocking time is provided during which no further pulse of the control signal leads to charging of primary coil 15.

In addition, it may be provided that to begin with, the overcurrent event must be present for longer than a defined period of time, e.g., between 10 μs and 50 μs, for an overcurrent event to be detected. This ensures that brief overswingers caused by parasitic oscillation circuits do not result in the unintentional switch-off of power switch 16 due to the faulty detection of an overcurrent.

In the transmission of the control signal from engine control device 2 to control logic 18 of ignition device 6 via the communications line, it must be ensured that signal flanks of the pulses are able to be differentiated from interference signals in an unambiguous manner. A suitable debouncing function both for positive and negative flank directions must be provided for this purpose, which detects a change in level as such only when the level at which the change in level occurs is applied in a stable manner for a defined period of time. For example, this is achieved in that in a flank change the initial state is stored, a time counter is triggered, and the start of a time count in the counter sums up the values applied at the input during the predefined time. After the time counter has expired, the portion of the levels with regard to all levels detected during the predefined period of time is determined, during which the level to which the edge change has led was applied. If the summation of the values indicates that a particular percentage (usually>50%), such as 60% or more of the levels, corresponds to the final state of the edge change, then it is detected as valid. In the other case, the previous state is maintained.

Furthermore, if the previously described debouncing method did not detect an edge change because of interference, it may be provided that a new check takes place in order to ascertain whether the applied input states agree after the fault time has elapsed and prior to the start of the fault time. If this is not the case, the debouncing method will be started anew.

Figure 5:
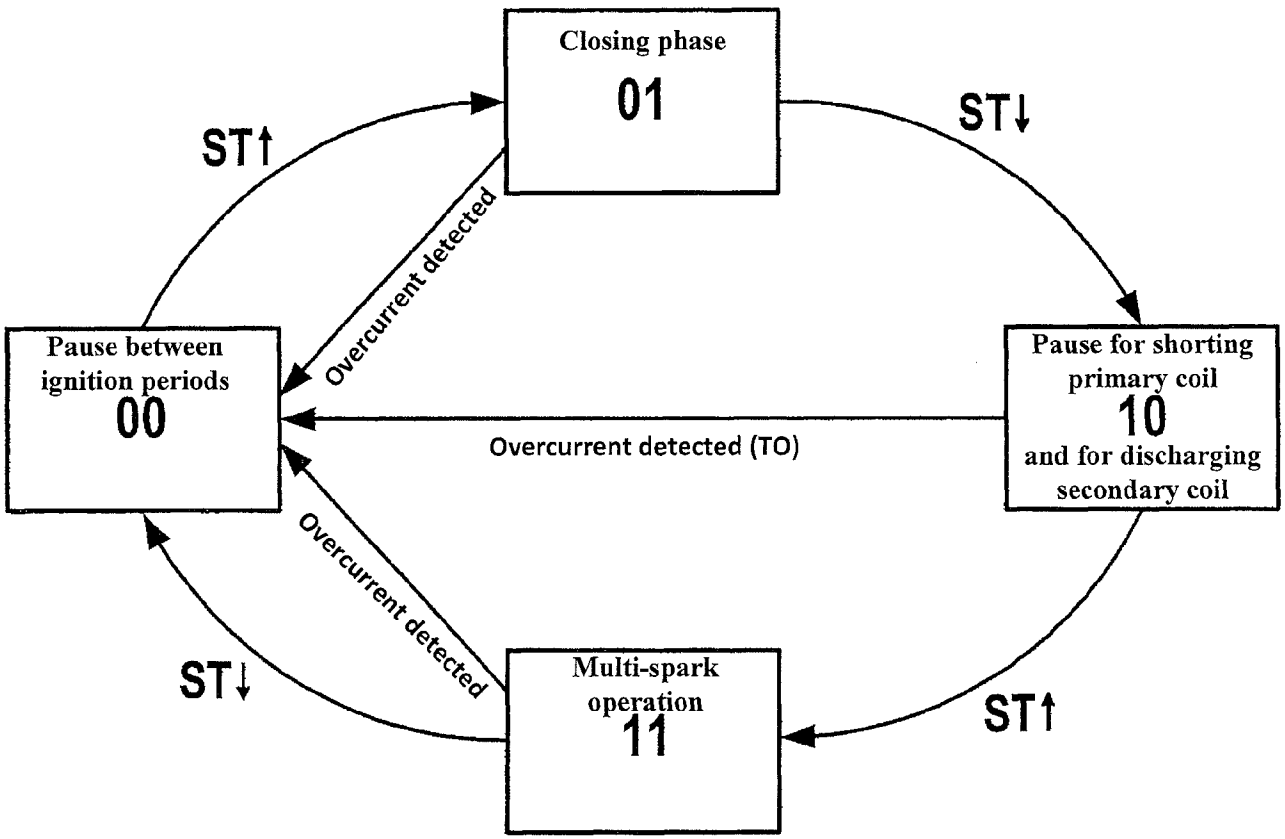
FIG. 5 shows a schematic illustration of a state machine for realizing the method for operating a multi-spark ignition system, using a state-transition diagram.

FIG. 5, using a state transition diagram for a state machine, schematically illustrates the realization of the method for operating a multi-spark ignition system. States "00" correspond to the pause between the ignition periods, state "01" to the closing phase, i.e., a state during which the primary coil is charged, state "10" to a pause during which the primary coil is short-circuited and the secondary coil discharges via an ignition spark, and state "11" corresponds to the afore-described multi-spark operation.

Starting with state "00", which corresponds to the pause between the ignition periods, a transition to state "01" takes place at a rising edge of control signal ST, in which state power switch 16 is closed for the purpose of charging primary coil 15 of ignition coil 14.

Starting out from state "01", following a specific predefined closing time, a transition takes place from state "01" to state "10" as a result of a trailing edge of control signal ST; at the same time, the switch-off of power switch 16 induces ignition coil 15 to generate an ignition spark. The state "10" provides for a minimum pause which is required for converting the energy stored in the secondary coil into a corresponding first ignition spark. In state "10", the pause between the end of state "01" and the start of state "11" may be 100 μs, for example.

Due to a subsequent rising edge of the control signal, a transition from state "10" to state "11" takes place in which the multi-spark operation in implemented. A multi-spark control is activated in the ignition device for this purpose, which cyclically charges the primary coil for a predefined period of time as previously described for as long as state "11" is present, and then partially discharges the secondary coil. State "11" is terminated by a trailing edge of control signal ST, so that a return to state "00" takes place. As an alternative or in addition, while state "11" is present, the number of charge and discharge processes of the ignition coil may be restricted to a specific number, so that the attainment of the specified number of discharge processes or a specific predefined maximum time period is assumed as an additional condition for the transition to the state "00". If the maximum time period or the maximum number of ignition sparks is exceeded and a trailing edge of control signal ST is not detected, then a transition to state "00" takes place according to an event "timeout" TO.

In state "00", no new charging of the primary coil is permitted following a trailing edge of the control signal in order to stop the multi-spark operation in a reliable manner. Once state "00" has been assumed, a specific blocking time is observed before state "01" is assumed once again at a rising edge of the control signal.

The occurrence of a reliably detected overcurrent leads to an immediate transition to state "00" from any state, which leads to an ignition in a charged ignition coil. The occurrence of an overcurrent should be detected in a reliable manner. For this purpose, it must be determined that the overcurrent is applied for a period in excess of a defined time, e.g., between 10 to 50 μs, preferably 30 μs, before an overcurrent event is detected. This ensures that brief overswingers resulting from parasitic oscillation circuits cannot lead to an undesired transition to state "00".

The overcurrent monitoring is active at all times, so that, when an overcurrent event ÜbStr has been detected, a transition from each state "01", "10", "11" to the state, "00" takes place.

As described above, the detection of the rising and trailing edge of control signal ST is usually implemented on the basis of a debounced control signal ST, so that a change of state intended by a change in the level of the control signal is able to be detected in a reliable manner. For example, the debouncing may be performed in that, once an edge change has been detected, the level of the control signal is detected in a manner offset in time, and an edge change ultimately is detected as valid when a certain portion of the levels of the control signal thus detected corresponds to the target level of the edge change. If, for instance, ten values of the level of the control signal are detected, then a valid edge change may be detected if six of the ten detected levels correspond to the target level.

What is claimed is:

1. An ignition device for operating an internal combustion engine, comprising:

a spark plug for generating multiple sparks;

an ignition coil for supplying an ignition voltage for the spark plug;

a control logic unit configured to receive time information regarding a multi-spark phase in order to cyclically charge the ignition coil and correspondingly discharge the ignition coil via the spark plug during the multi-spark phase, wherein:

the control logic unit is configured to implement the charging and the discharging of the ignition coil as a function of a current flow in the ignition coil;

the control logic is configured to receive time information regarding a single-spark phase prior to the receiving of the time information regarding the multi-spark phase, the start of the single-spark phase indicating the start of the charging of the ignition coil, and the end of the single-spark phase indicating the start of the discharging of the ignition coil;

the control logic unit is configured to receive the time information regarding the single spark phase in the form of a first pulse of a control signal during an ignition phase, and to receive the time information regarding the multi-spark phase in the form of a second pulse of the control signal; and a predetermined minimum time period is provided between the first pulse and the second pulse, the minimum time period ensuring that sufficient energy is transmitted into a spark of the single-spark phase.

2. The ignition device as recited in claim 1, wherein the control logic is configured to implement the charging and discharging of the ignition coil as a function of a current flow through a primary circuit of the ignition coil and as a function of a current flow through a secondary circuit of the ignition coil.

3. An engine control system for operating an internal combustion engine having an ignition device, comprising:

a control device configured to generate a first pulse of a control signal for triggering a single spark in the ignition device, and to generate, after the first pulse, a second pulse of the control signal as a function of a type of ignition operation, wherein the duration of the second pulse defines the duration of a multi-spark phase in the ignition device;

wherein the ignition device includes:

a spark plug for generating sparks;

an ignition coil for supplying an ignition voltage for the spark plug; and a control logic unit configured to receive time information regarding a multi-spark phase in order to cyclically charge the ignition coil and correspondingly discharge the ignition coil via the spark plug during the multi-spark phase, wherein the control logic unit is configured to implement the charging and the discharging of the ignition coil as a function of a current flow in the ignition coil; and wherein the control device is configured to provide a minimum time period between the first pulse and the second pulse, the minimum time period ensuring that sufficient energy is transmitted into the single spark.

4. An ignition system, comprising:

an ignition device for an internal combustion engine, including:

a spark plug for generating multiple sparks;

an ignition coil for supplying an ignition voltage for the spark plug;

a control logic unit configured to receive time information regarding a multi-spark phase in order to cyclically charge the ignition coil and correspondingly discharge the ignition coil via the spark plug during the multi-spark phase, wherein the control logic unit is configured to implement the charging and the discharging of the ignition coil as a function of a current flow in the ignition coil; and a control device configured to generate a first pulse of a control signal for triggering a single spark in the ignition device, and to generate, after the first pulse, a second pulse of the control signal as a function of a type of ignition operation, wherein:

the duration of the second pulse defines the duration of a multi-spark phase in the ignition device; and the control device provides a minimum time period is provided between the first pulse and the second pulse, the minimum time period ensuring that sufficient energy is transmitted into the single spark.

5. A method for operating a multi-spark ignition system in an engine system, comprising:

receiving time information regarding a multi-spark phase;

performing, during the multi-spark phase, a cyclical charging of an ignition coil of an ignition device and a corresponding cyclical discharging of the ignition coil via a spark plug of the ignition device;

wherein:

at least one of the charging and discharging of the ignition coil takes place as a function of a current flow in the ignition coil;

time information regarding a single-spark phase is received prior to the receiving of the time information regarding the multi-spark phase;

the start of the single-spark phase indicates the start of the charging of the ignition coil, and the end of the single-spark phase indicates the start of the discharging of the ignition coil;

the time information regarding the single-spark phase is provided by a first pulse of a control signal provided to the ignition system;

the time information regarding the multi-spark phase is provided by a second pulse of the control signal provided to the ignition system;

a predetermined minimum time period is provided between the first pulse and the second pulse, the minimum time period being selected to ensure that sufficient energy is transmitted into a spark of the single-spark phase; and at least one of a front edge of the first pulse and a rear edge of the second pulse is debounced in the ignition system.

6. The method as recited in claim 5, wherein the charging and discharging of the ignition coil is performed as a function of a current flow through a primary circuit of the ignition coil and as a function of a current flow through a secondary circuit of the ignition coil.

7. The method as recited in claim 6, wherein the charging of the ignition coil is continued until a switch-off threshold is reached by the current flow in the primary circuit of the ignition coil, and wherein the discharging of the ignition coil is continued until a switch-on threshold is reached by the current flow in the secondary circuit of the ignition coil.

8. The method as recited in claim 7, wherein the time information regarding the multi-spark phase corresponds to a predetermined maximum number of ignition processes in the multi-spark phase.

* * * * *